US006644733B1

(12) United States Patent
Tseng

(10) Patent No.: US 6,644,733 B1
(45) Date of Patent: Nov. 11, 2003

(54) CHAIR WITH A SEAT SLIDABLE RELATIVE TO A SEAT BASE FOR SYNCHRONOUSLY ACTUATING A FOOTREST AND A BACKREST

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/217,274

(22) Filed: Aug. 12, 2002

(51) Int. Cl.[7] ..... A47C 1/02

(52) U.S. Cl. ..... 297/68; 297/84; 297/85; 297/90; 297/322

(58) Field of Search ..... 297/68, 83, 84, 297/85, 86, 90, 91, 316, 317, 322

(56) References Cited

U.S. PATENT DOCUMENTS 3,558,185 A * 1/1971 Mizelle ..... 297/84
3,572,823 A * 3/1971 Hampton ..... 297/85
3,743,348 A * 7/1973 Sloan ..... 297/85
4,544,201 A * 10/1985 Rogers, Jr. ..... 297/68
4,663,673 A * 5/1987 Doutsubo ..... 386/68
4,863,215 A * 9/1989 Crum ..... 297/85
5,823,614 A * 10/1998 Johnson et al. ..... 297/85
6,135,559 A * 10/2000 Kowalski ..... 297/68

* cited by examiner

*Primary Examiner*—Anthony D. Barfield
(74) *Attorney, Agent, or Firm*—Ladas & Parry

(57) ABSTRACT

A chair includes a seat base, a seat slidably mounted on the seat base, a backrest disposed rearwardly of the seat base, a footrest disposed frontwardly of the seat base, a front linkage unit interconnecting the footrest to the seat base, and a rear linkage unit interconnecting the backrest to the seat base. An operating lever is mounted on the seat base, is associated with the front and rear linkage units, and is operable to move between a locking position, in which, the seat is prevented from movement relative to the seat base by virtue of the body weight of a user, and an unlocking position, in which, the seat is movable relative to the seat base by virtue of the body weight of the user.

2 Claims, 6 Drawing Sheets

CHAIR WITH A SEAT SLIDABLE RELATIVE TO A SEAT BASE FOR SYNCHRONOUSLY ACTUATING A FOOTREST AND A BACKREST

BACKGROUND OF THE INVENTION

1. Field of the Invention

The present invention relates to a chair, more particularly to a chair with a seat that is slidable relative to a seat base for synchronously actuating a footrest and a backrest.

2. Description of the Related Art

Referring to FIGS. 1 and 2, a conventional chair is shown to include a seat 11, a footrest 13 disposed frontwardly of the seat 11, a backrest 12 disposed rearwardly of the seat 11, a front linkage unit that interconnects the footrest 13 and the seat 11, and a rear linkage unit that interconnects the backrest 12 and the seat 11. A control unit 14 interconnects the front and rear linkage units, and includes an operating lever exposed outwardly from the seat 11. Turning of the operating lever in clockwise and counterclockwise directions results in inclination adjustment of the backrest 12 and extension and retraction of the footrest 13 relative to the seat 11.

One drawback of the aforementioned conventional chair is that adjustment of the backrest 12 and the footrest 13 relative to the seat 11 can only be conducted by operating the operating lever, thereby inconveniencing the user.

SUMMARY OF THE INVENTION

Therefore, the object of this invention is to provide a chair having a backrest and a footrest, which can be adjusted relative a seat merely by virtue of movement of the body weight of a seated person so as to eliminate the aforementioned drawback associated with the prior art.

Accordingly, a chair of the present invention includes: a seat base having left and right sides, and front and rear ends; a slidable seat mounted slidably on the seat base; a backrest disposed rearwardly of the seat base, and having a lower end; a footrest disposed frontwardly of the seat base; and a front linkage unit interconnecting the seat base and the footrest, and including a pair of parallel linkage mechanisms disposed at the left and right sides of the seat base, respectively. Each of the linkage mechanisms includes a pair of rear links with front and rear ends, and a pair of front links with front and rear ends. The front ends of the front links are pivoted to the footrest. The rear ends of the front links are respectively pivoted to the front ends of the rear links. The rear end of one of the rear links is pivoted to the seat base. The rear end of the other one of the rear links is pivoted to the slidable seat so as to permit folding and unfolding of the linkage mechanisms, which, in turn, results in frontward and rearward movement of the footrest relative to the seat base. A rear linkage unit interconnects the seat base and the backrest, and includes a pair of crank mechanisms disposed at the left and right sides of the seat base, respectively. Each of the crank mechanisms includes a frame, a crank, a lever, and a coupler. The frame is fixed on and projects outwardly and rearwardly from the rear end of the seat base. The crank is fixed on and projects outwardly and downwardly from the lower end of the backrest, and is pivoted to the frame. The lever is pivoted to and projects rearwardly and downwardly from the frame. The coupler is interposed between the crank and the lever, and has two opposing ends respectively pivoted to the crank and the lever so as to permit co-swinging of the crank, the lever and the coupler relative to the frame when the seat slides frontward and rearward relative to the seat base and so as to permit inclination of the backrest relative to the seat. A pair of auxiliary links are disposed at the left and right sides of the seat base, respectively. Each of the auxiliary links extends between and is connected pivotally to the seat base and the lever so as to prevent disengagement between the slidable seat and the seat base when the slidable seat slides on the seat base.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
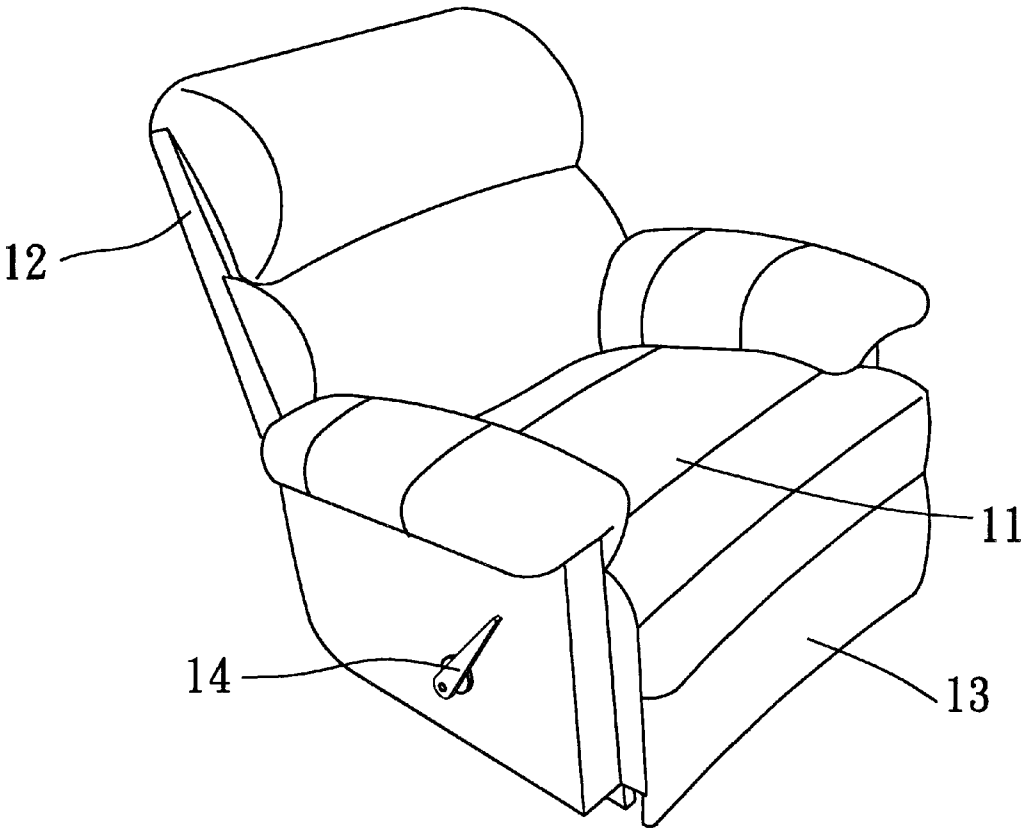
FIG. 1 PRIOR ART
FIG. 1 is a perspective view of a conventional chair.
Figure 2:
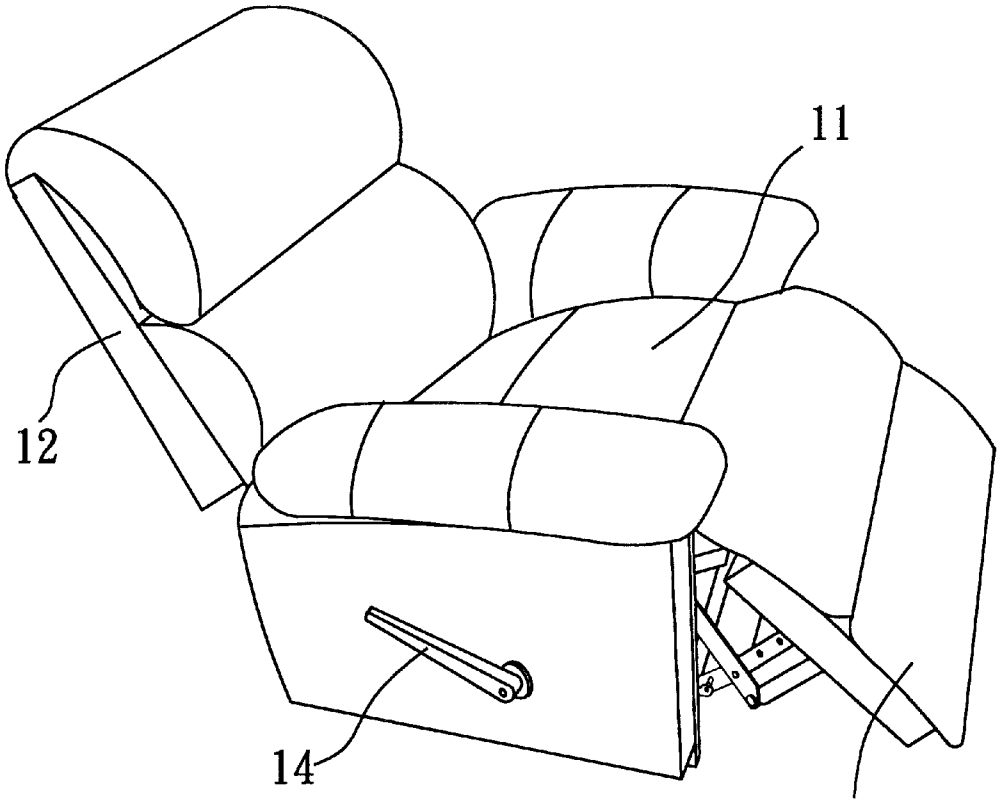
FIG. 2 PRIOR ART
FIG. 2 is a perspective view of the conventional chair, illustrating how an operating lever is actuated in order to adjust position of a footrest and a backrest relative to a seat.
Figure 3:
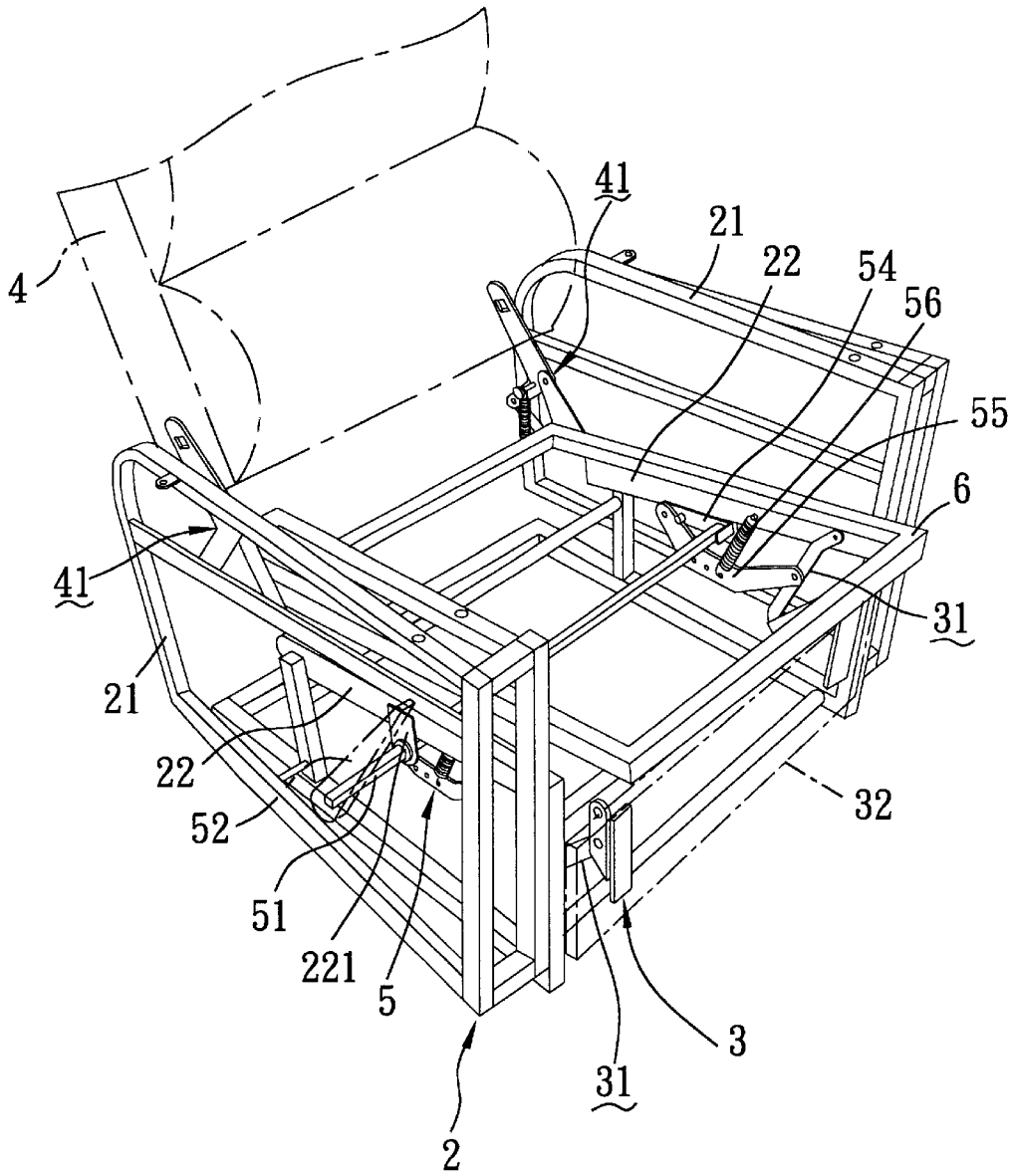
FIG. 3 is a fragmentary perspective view of the preferred embodiment of a chair according to the present invention with sofa removed therefrom to illustrate how a footrest and a backrest are connected to a seat base via linkage units.
Figure 4:
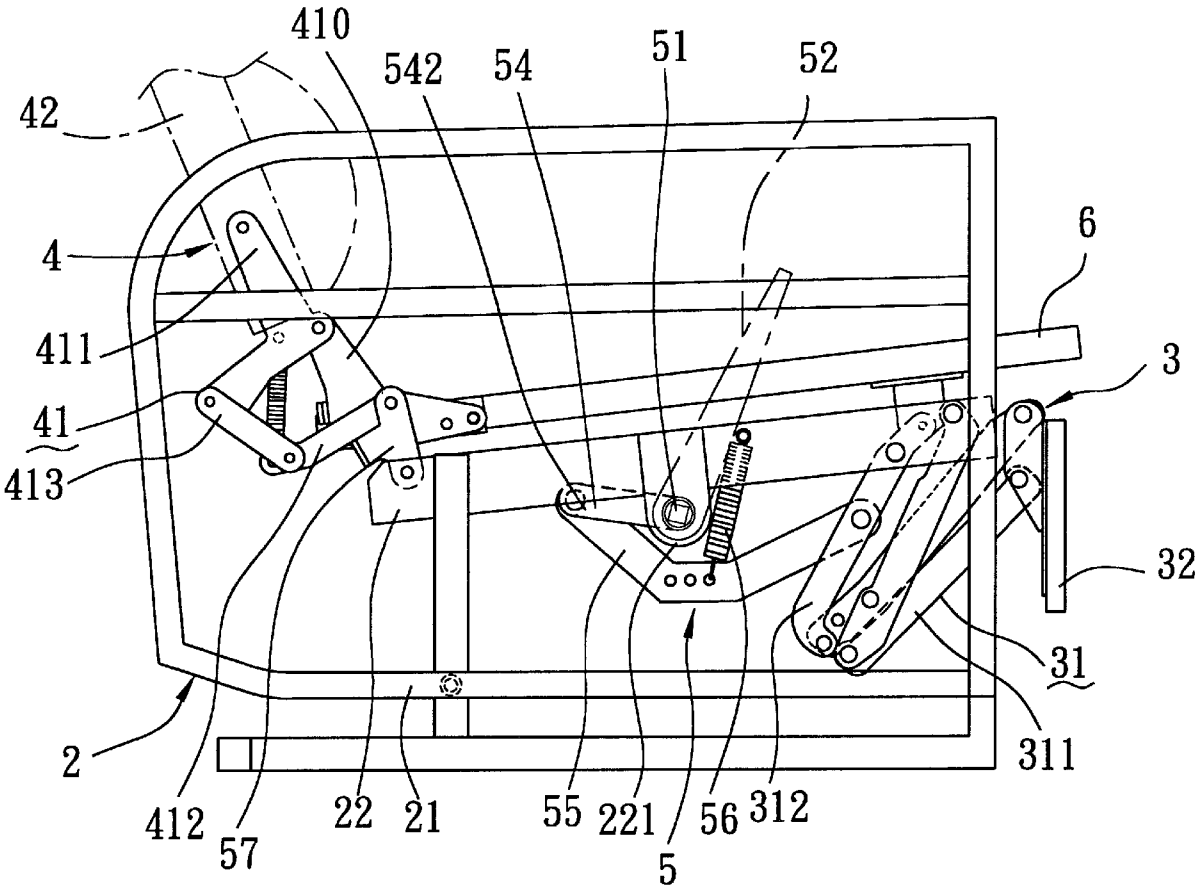
FIG. 4 is a fragmentary side view of the preferred embodiment, illustrating a state where the backrest and the footrest are not extendible relative to the seat base.
Figure 5:
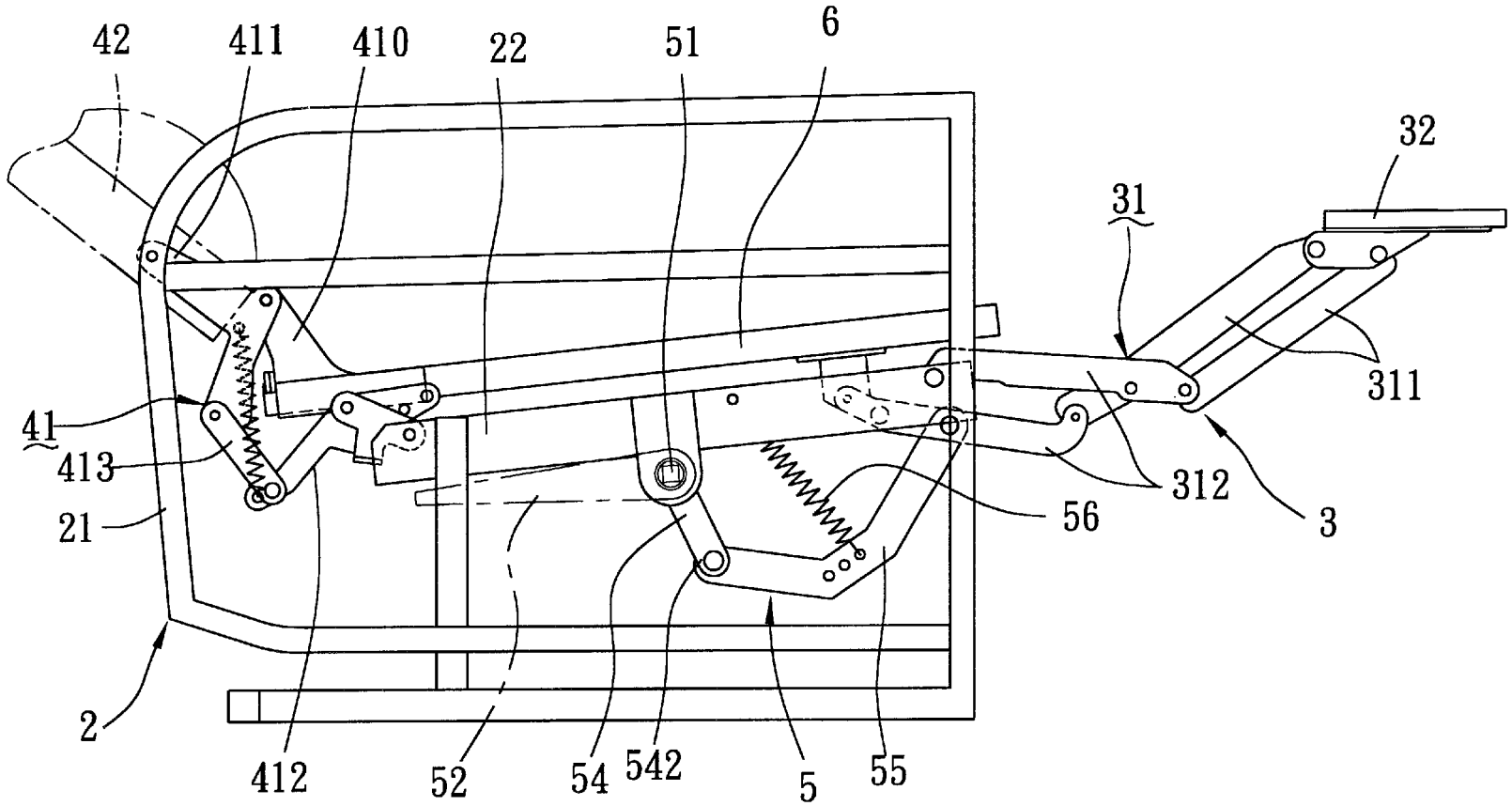
FIG. 5 is a fragmentary side view of the preferred embodiment, illustrating a state where the backrest and the footrest are extended outwardly from the seat base.

Referring to FIGS. 3 to 5, the preferred embodiment of a chair according to the present invention is shown to include a seat base 22, a slidable seat 6, a backrest 4, a footrest 32, a front linkage unit 3, a rear linkage unit, and a pair of auxiliary links 57.

As illustrated, a seat base 22 has left and right sides, and front and rear ends.

The seat 6, which is in the form of a horizontal frame, is mounted slidably on the seat base 22. Left and right upright armrest frames 21 are respectively disposed at two opposite sides of the seat 6 to facilitate resting of a seated person's arms thereon.

The backrest 4 is disposed rearwardly of the seat base 22, and has a lower end 42.

The footrest 32 is disposed frontwardly of the seat base 22.

The front linkage unit 3 interconnects the seat base 22 and the footrest 32, and includes a pair of parallel linkage mechanisms 31 disposed at the left and right sides of the seat base 22, respectively. Each of the linkage mechanisms 31 includes a pair of rear links 312 with front and rear ends, and a pair of front links 311 with front and rear ends. The front ends of the front links 311 are pivoted to the footrest 32. The rear ends of the front links 311 are respectively pivoted to the front ends of the rear links 312. The rear end of one of the rear links 312 is pivoted to the seat base 22. The rear end of the other one of the rear links 312 is pivoted to the slidable seat 6 so as to permit folding and unfolding of the linkage mechanisms 31, which, in turn, results in frontward and rearward movements of the footrest 32 relative to the seat base 22.

The rear linkage unit interconnects the seat base 22 and the backrest 4, and includes a pair of crank mechanisms 41 disposed at the left and right sides of the seat base 22, respectively. Each of the crank mechanisms 41 includes a frame 410, an L-shaped crank 411, a lever 412, and a coupler 413. The frame 410 is fixed on and projects outwardly and rearwardly from the rear end of the seat base 22. The crank 411 is fixed on and projects outwardly and downwardly from the lower end 42 of the backrest 4, and is pivoted to the frame 410. The lever 412 is pivoted to and projects rearwardly and downwardly from the frame 410. The coupler 413 is interposed between the crank 411 and the lever 412, and has two opposing ends respectively pivoted to the crank 411 and the lever 412 so as to permit co-swinging of the crank 411, the lever 412 and the coupler 413 relative to the frame 410 when the seat 6 slides forward and rearward relative to the seat base 22 and so as to permit inclination of the backrest 4 relative to the seat 6.

Each of the auxiliary links 57 extends between and is connected pivotally to the seat base 22 and the lever 412 so as to prevent disengagement between the seat 6 and the seat base 22 when the seat 6 slides on the seat base 22.

Figure 6:
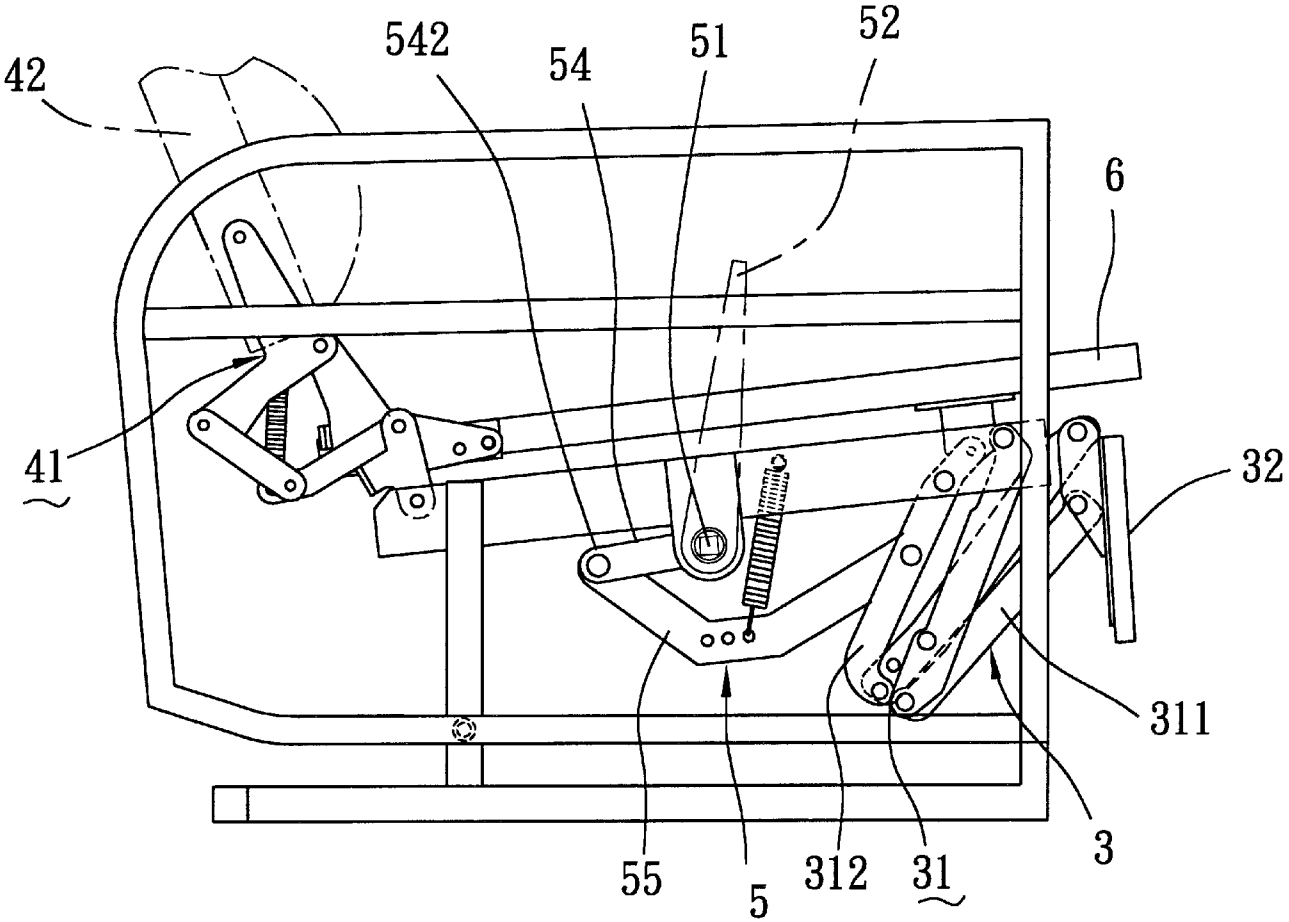
FIG. 6 is a fragmentary side view of the preferred embodiment, illustrating a state where the backrest and the footrest can be extended outwardly from the seat base by virtue of body weight of a seated person.

The invention further comprises a control unit 5 which is provided on the preferred embodiment, and which includes a shaft 51, a first link 54, a generally curved second link 55, and an operating lever 52. The shaft 51 is disposed below the slidable seat 6, and is mounted rotatably on the seat base 22 via two mounting lugs 221 that project downwardly from the seat base 22. The shaft 51 extends in a transverse direction relative to the left and right sides of the seat base 22. The first link 54 is secured to and extends transversely from the shaft 51. The first link 54 has a pivot end 542 that is distal from the shaft 51. The second link 55 has a first end pivoted to the pivot end 542 of the first link 54, and a second end pivoted to the one of the of rear links 312 that is pivoted to the seat 6. The operating lever 52 is secured to the shaft 51, and is operable to turn the first link 54 via the shaft 51 between a locking position, as best shown in FIG. 4, and an unlocking position, as best shown in FIG. 6. At the locking position, the pivot end 542 of the first link 54 is disposed rearwardly of the shaft 51 at an elevation above the shaft 51 so as to prevent the first link 54 from counterclockwise rotation when an external force, i.e. force exerted by the feet of a seated person, is applied to the footrest 32 to push the footrest 32 away from the seat base 22, thereby preventing sliding movement of the seat 6 relative to the seat base 22. At the unlocking position of FIG. 6, the pivot end 542 of the first link 54 is disposed rearwardly of the shaft 51 at an elevation therebelow so as to permit counterclockwise rotation of the first link 54, thereby permitting sliding movement of the seat 6 relative to the seat base 22 by virtue of the body weight of the seated person, which, in turn, actuates the footrest 32 and the backrest 4 via the front linkage unit 3 and the rear linkage unit move to the position as shown in FIG. 5. A first tension spring 56 interconnects the second link 55 and the seat base 22 to provide resistance to forward movement of the footrest 13. A second tension spring is disposed between and interconnects the crank 411 and the coupler 413 so as to provide resistance to rearward turning of the backrest 4 relative to the seat base 22.

With this invention thus explained, it is apparent that numerous modifications and variations can be made without departing from the scope and spirit of this invention. It is therefore intended that the invention be limited only as indicated in the appended claims.

I claim:

1. A chair comprising:

a seat base having left and right sides, and front and rear ends;

a slidable seat mounted slidably on said seat base;

a backrest disposed rearwardly of said seat base, and having a lower end;

a footrest disposed frontwardly of said seat base;

a front linkage unit interconnecting said seat base and said footrest, and including a pair of parallel linkage mechanisms disposed at said left and right sides of said seat base, respectively, each of said linkage mechanisms including a pair of rear links with front and rear ends, and a pair of front links with front and rear ends, said front ends of said front links being pivoted to said footrest, said rear ends of said front links being respectively pivoted to said front ends of said rear links, said rear end of one of said rear links being pivoted to said seat base, and said rear end of the other one of said rear links being pivoted to said slidable seat so as to permit folding and unfolding of said linkage mechanisms, which, in turn, results in frontward and rearward movement of said footrest relative to said seat base;

a rear linkage unit interconnecting said seat base and said backrest, and including a pair of crank mechanisms disposed at said left and right sides of said seat base, respectively, each of said crank mechanisms including a frame fixed on and projecting outwardly and rearwardly from said rear end of said seat base, a crank fixed on and projecting outwardly and downwardly from said lower end of said backrest and pivoted to said frame, a lever pivoted to and projecting rearwardly and downwardly from said frame, and a coupler that is interposed between said crank and said lever and that has two opposing ends respectively pivoted to said crank and said lever so as to permit co-swinging of said crank, said lever and said coupler relative to said frame when said seat slides forward and rearward relative to said seat base and so as to permit inclination of said backrest relative to said seat; and a pair of auxiliary links disposed at said left and right sides of said seat base, respectively, each of said auxiliary links extending between and being connecting pivotally with said seat base and said lever so as to prevent disengagement between said slidable seat and said seat base when said slidable seat slides on said seat base.

2. The chair as defined in claim 1, further comprising a control unit which includes a shaft mounted rotatably on said seat base below said slidable seat and extending in a transverse direction relative to said left and right sides of said seat base, a first link secured to and transversely extending from said shaft and having a pivot end distal from said shaft, a second link having a first end pivoted to said pivot end of said first link and a second end pivoted to one of said pair of rear links, and an operating lever secured to said shaft and operable to turn said first link via said shaft between a locking position, in which said pivot end of said first link is disposed rearwardly of said shaft at an elevation above said shaft, and an unlocking position, in which said pivot end of said first link is disposed rearwardly of said shaft at an elevation below said shaft.

* * * * *